US010253547B2

(12) United States Patent
Peck et al.

(10) Patent No.: US 10,253,547 B2
(45) Date of Patent: Apr. 9, 2019

(54) PORTABLE, UNIVERSALLY FITTING, SECURITY BOX THAT ATTACHES TO A FIXED OBJECT TO SECURE VALUABLES

(71) Applicants: Robert Michael Peck, Queensbury, NY (US); Jonathan Bradley Kinas, Aventura, FL (US); Avin Samtani, New York, NY (US)

(72) Inventors: Robert Michael Peck, Queensbury, NY (US); Jonathan Bradley Kinas, Aventura, FL (US); Avin Samtani, New York, NY (US)

( * ) Notice: Subject to any disclaimer, the term of this patent is extended or adjusted under 35 U.S.C. 154(b) by 0 days.

(21) Appl. No.: 14/253,338

(22) Filed: Apr. 15, 2014

(65) Prior Publication Data

US 2016/0222715 A1 Aug. 4, 2016

Related U.S. Application Data

(63) Continuation-in-part of application No. 13/413,017, filed on Mar. 6, 2012, now abandoned.

(51) Int. Cl.

| | |
|---|---|
| ***E05G 1/00*** | (2006.01) |
| ***A47C 1/14*** | (2006.01) |
| ***A47C 7/62*** | (2006.01) |
| ***E05G 1/04*** | (2006.01) |
| ***E05G 1/026*** | (2006.01) |

(52) U.S. Cl.

CPC ..... *E05G 1/005* (2013.01); *A47C 1/14* (2013.01); *A47C 7/62* (2013.01); *E05G 1/026* (2013.01); *E05G 1/04* (2013.01); *E05Y 2800/17* (2013.01)

(58) Field of Classification Search

CPC ..... E05G 1/005; E05G 1/026; E05G 1/04; E05G 1/00; E05G 1/02; E05G 1/024; E05G 2700/00; E05G 2700/02; E05Y 2800/17; A47C 1/14; A47C 7/62; A45C 1/12

USPC ..... 70/58, 63, 261, 158–173, 18, 19, 177, 70/178, 180; 109/50–52, 58, 58.5, 59 R, 109/59 T, 64, 78; 248/551–553; 297/188.18, 188.19, 188.2, 188.13, 297/188.14, 188.01, 188.15, 188.21; 220/475, 480–483, 676; 5/931; 108/26, 108/28, 29; 232/4 R; 446/8

See application file for complete search history.

(56) References Cited

U.S. PATENT DOCUMENTS

| | | | | |
|---|---|---|---|---|
| 1,026,649 A | | 5/1912 | Beshore | |
| 1,251,591 A | * | 1/1918 | Stoddart | E05B 37/16 70/178 |
| 1,404,263 A | * | 1/1922 | Bludworth | F01P 11/0214 220/DIG. 32 |
| 2,755,748 A | | 7/1956 | Abell, Jr. | |

(Continued)

*Primary Examiner* — Lloyd A Gall

(74) *Attorney, Agent, or Firm* — Richard Allison

(57) ABSTRACT

A portable, universally fitting, stylish, lockable security box that integrally affixes to an object such as the support or cross bar on a frame of a beach lounge chair, a stroller, bike or similar member where it is desirable to protect your valuables on a stationary or a larger movable object. The security box includes an internal cavity that is formed by the two main components which makes this device simple and attractive. The exterior surface is preferably configured with tapered or rounded edges and a flush closure of the top and bottom components, wherein the risk of a snag or injury to the user is greatly reduced and to not interfere with the function or operation of the component to which it is attached.

5 Claims, 8 Drawing Sheets

(56) References Cited

U.S. PATENT DOCUMENTS 2,785,564 A * 3/1957 Carrato ..... B62D 53/085 70/232
2,813,620 A 11/1957 Hansen
3,340,709 A * 9/1967 Callahan ..... E05B 13/001 70/165
3,587,486 A 6/1971 Heinrichs
3,636,742 A 1/1972 Raney
3,742,741 A 7/1973 Cahan
4,061,395 A 12/1977 Boole
4,364,499 A * 12/1982 McCue ..... B60R 7/14 211/64
4,463,584 A 8/1984 De Forrest
4,561,273 A * 12/1985 Robinson ..... E05B 13/001 70/209
4,573,332 A 3/1986 Ma
4,577,477 A 3/1986 Olshausen
4,651,544 A 3/1987 Hungerford
4,667,491 A 5/1987 Lokken et al.
4,674,303 A 6/1987 Salcone, II
4,777,811 A * 10/1988 Binkley ..... F16B 41/005 70/178
4,881,386 A * 11/1989 Glines ..... B60R 7/14 211/64
4,971,390 A 11/1990 McGinley
4,991,413 A * 2/1991 Arnaldo ..... A47F 7/0243 340/572.9
4,998,424 A 3/1991 Lambert, II
5,027,622 A * 7/1991 Hatch ..... A47F 5/0861 211/59.1
5,056,342 A 10/1991 Prinz
5,074,617 A 12/1991 Maxwell
5,531,082 A 7/1996 Wolk et al.
5,595,073 A * 1/1997 Sullivan ..... E05B 17/002 70/159
5,697,235 A * 12/1997 Briones ..... B60R 25/0221 70/18
D396,736 S 8/1998 Davis
5,875,659 A 3/1999 Nosse
6,085,671 A 7/2000 Kerr et al.
6,363,760 B1 4/2002 Sigmond
7,188,896 B2 * 3/2007 Embach ..... B60N 2/4876 297/188.01
7,305,858 B1 12/2007 Wu
7,607,933 B2 10/2009 Shai et al.
7,641,279 B1 1/2010 Curcio
7,967,164 B1 * 6/2011 Mountain ..... B65D 90/24 220/377
8,201,506 B1 6/2012 Parlapiano
D695,485 S * 12/2013 Peck ..... D99/28
8,789,884 B1 * 7/2014 Edelman ..... A47C 7/62 297/188.08
8,826,702 B1 * 9/2014 Barger ..... E05B 73/00 211/4
D791,424 S * 7/2017 Peck ..... A47C 7/62 D99/28
9,822,578 B2 * 11/2017 Peck ..... E05G 1/005
2004/0112099 A1 6/2004 Randall
2004/0262315 A1 * 12/2004 Yoon ..... B65D 43/162 220/480
2005/0121455 A1 * 6/2005 Lee ..... D06F 95/006 220/676
2009/0044736 A1 2/2009 Huber et al.
2011/0232339 A1 9/2011 Norman et al.
2014/0014009 A1 * 1/2014 Crockwell ..... E05G 1/06 109/53

* cited by examiner

PORTABLE, UNIVERSALLY FITTING, SECURITY BOX THAT ATTACHES TO A FIXED OBJECT TO SECURE VALUABLES

PRIORITY CLAIM

The present application is a continuation-in-part application of application Ser. No. 13/413,017 filed on Mar. 6, 2012 now abandoned.

DESCRIPTION OF PRIOR ART

In general, examples of the concept of having a lock box that attaches to a fixed object are known. The following patents and patent applications are illustrative of the known prior art in this area.

1. U.S. Pat. No. 4,061,395 issued to Boole in 1977 for "Portable Drawer Assembly".
2. U.S. Pat. No. 7,305,858 issued to Wu in 2007 for "Security box"
3. U.S. Pat. No. 4,573,332 issued to Ma in 1986 for "Portable Securitybox"
4. U.S. Pat. No. 7,607,933 issued to Shai in 2009 for "Portable tool box locker"
5. U.S. Pat. No. 6,085,671 issued to Kerr in 2000 for "Lock box"
6. U.S. Pat. No. 5,531,082 issued to Wolk in 1996 for "Portable Security Case"
7. U.S. Pat. No. 4,971,390 issued to McGinley in 1990 for "Safety Locker Drawer for use with a chair"
8. U.S. Pat. No. 4,667,491 issued to Lokken in 1987 for "Portable Travel Safe"
9. U.S. Pat. No. 2,755,748 issued to Abell in 1953 for "Portable Lock box"

BACKGROUND OF THE INVENTION

This invention relates to a self-contained safe, lockable container, or lock box for securing valuables and more particularly to a portable, lockable security box that may be secured to a fixed object. It has long been known that when people are at a place of relaxation or recreation (beach, pool, camp, park, or other outdoor activity) people are concerned that their valuables are safe and secure. This invention is a simple way to secure valuables to a fixed object in a stylish, universal fit, with a specially designed lockable container. This invention will greatly reduce the worry a person has concerning the security of their valuables when they use the invention, such as when they go for a swim, wherein previously one would hide objects in sneakers or under a towel.

The present invention relates to a portable, lockable security box such as a security box, self-contained safe, lockable container, portable security safe or similar device. The above examples are all similar in concept but lack the simplicity and features which are important elements which the present invention provides. Cable locks, Sliding trays, complex mounting mechanisms, multiple component assemblies, and materials subject to degradation are all embodied in the prior innovations. The present invention utilizes innovative features to solve the prior problems by providing a novel solution.

The traditional safe is used to store objects in such a way as to restrict access to these objects. Typically, safes are meant to be permanent objects which are highly impregnable except to users with access to the safe's inner contents by way of a key or knowledge of a combination. However, in order to keep the safe, and its contents, from being easily removed, traditional safes have been intentionally designed to be heavy, bulky, and difficult to move. In certain instances, individuals may desire to restrict access to objects, such as their wallet, keys, phone, firearm, or other items, while they are somewhere in which it would be impractical to bring a traditional safe. Thus, one may desire to have a portable safe to store valuables while temporarily out of view of the valuables, such as when swimming, enjoying recreational activities, or relaxing on beach or pool lounge chairs. However, because it would be undesirable for the portable safe to be portable while the user is using the safe to restrict access to the safe's contents, it is also desirable to provide a lockable storage container that is self-contained and removably attachable to a variety of other fixed or secure elements such as patio chairs, strollers, bikes or structural members. People commonly carry valuables such as cell phones, watches, wallets, glasses, room keys, etc. with them. When a person decides to do an activity where it is not convenient or where they cannot take all of their valuables with them, the person must decide what to do to make sure their valuables are not stolen when they are temporarily out of view of them. Prior to this invention, one had to use a complex lock box with a chain or mounting brackets to store their valuables. Alternatively, locking boxes were placed on door knobs or were limited to use on the non-supporting areas of a specific type of chair, but did not have the flexibility to be secured to any desirable elongate object nor the space to store valuables from multiple people. Prior to this invention, there was no safe capable of true portability combined with the ability to attach to structural elements in a truly removable fashion. Without a portable safe, the only option is to hide valuables out of sight, such as under a towel, and hope the valuables are there when one returns. Despite market demand, prior attempts to address this problem have fallen short as a result of a failure to address the problem in the novel manner disclosed herein. A simplified design of the type disclosed herein with innovative features exemplifies an invention that has been desired in the marketplace and is more fully described herein.

SUMMARY OF THE INVENTION

The portable, lockable security box of the present invention is specifically designed to store valuables at a variety of locations, such as the beach, pool or other recreation area. The unique, one of a kind security box of the present invention self-fastens to an elongate object, including a support member such as on a lounge chair or stroller, a boat or golf cart safety rail, a secured rope, or even a bicycle frame. The security box opens up and closes over a bar of a lounge chair frame, stroller or other support element and can then be securely locked. In order to accommodate a support element, the security box ingeniously includes a versatile support cavity. The support cavity is made up of an arcuate portion, a corner lip, and a straight portion on each of two side openings in the security box. In an example of one generally preferred form of the invention, the support cavity fits on a wide variety of support elements, such as a square support with a diameter approximately 2 inches square or a round bar with a diameter of approximately 2 inches or less, such as lounge chair support bar frames or stroller frame. This unique security box is self-contained and completely portable. Unlike prior attempts to solve the problem addressed by the present invention, this security box does not require permanent fixation to the support element, such as being bolted on or screwed down, and does not require assembly, such as the insertion of a pivotable arm or a pawl. The present invention is ideal for use at the beach, park or pool, wherein the security box can be filled with any valuables of allowable size that the owner would like to secure, enclosed over any elongate object that is part of the lounge chair, stroller or structural member and then locked using the locking mechanism that comes with the lockable security box (ex. Integral Briefcase Lock) or external padlock. The present invention is designed to provide a level of security at the beach, park, or pool so that the owner can leave the stored items unattended and not have to worry about them as they would if the same items were left out in the open. This security box is a theft deterrent device which, if used properly, should decrease the probability that valuables are stolen at the beach, park or pool. It is submitted that a potential thief is less likely to attempt to break open the present invention and potentially draw attention to themselves rather than quickly search unattended towels and shoes that are likely hiding places for valuables. Additionally, the nature of the materials of the present invention do not allow the thief to see what, if anything is located in the portable, lockable security box, thereby further reducing the likelihood that a thief will target the lockable security box rather than searching for easier targets.

In a preferred form of the present invention, the security box is specifically designed to be temporarily affixed to lounge chairs by use of integral side openings which surround the elongate support bar on the back of a lawn or beach chair. Placing the security box on the back of a chair, wherein it would not be easily visible from the front of the chair, has aesthetic utility as well as providing an additional level of security due to the decreased visibility, especially if the chair were situated against a wall or sand dune. Furthermore, the exterior shape of the lock box is generally a 3D ellipse, ovoid or bulbous shaped and has multiple rounded edges so as to not interfere with the operation of the device to which it is attached while maximizing the internal storage space. Furthermore, the top and bottom components are designed to close flush with each other, as opposed to one being larger than the other, which decreases the likelihood of a snag or injury by the user of the security box. The support cavity is configured with two versatile side openings to engage a variety of cross-sectional shapes of elongate support members to which it can attach. As described more fully below, the security box preferably includes a greater length between the side openings of the support cavity than the front to back dimension.

The present invention relates generally to a simplified, portable, universally fit, lockable container that attaches to a fixed object to store valuables that includes a top component that connects to the bottom component by means of a hinge which has a built in support cavity that will fit a variety of different sized fixed objects such as the metal frame supports of beach or lounge chairs with an integral compartment that will store valuables such as cell phones, wallets, watches, glasses, room keys, and other valuables which is secured by an integrated hasp mechanism or integrated lock system under which the fixed object is also clasped in which will prevent unauthorized entry when swimming or enjoying recreational activities.

DETAILED DESCRIPTION OF THE DRAWINGS

Figure 1:
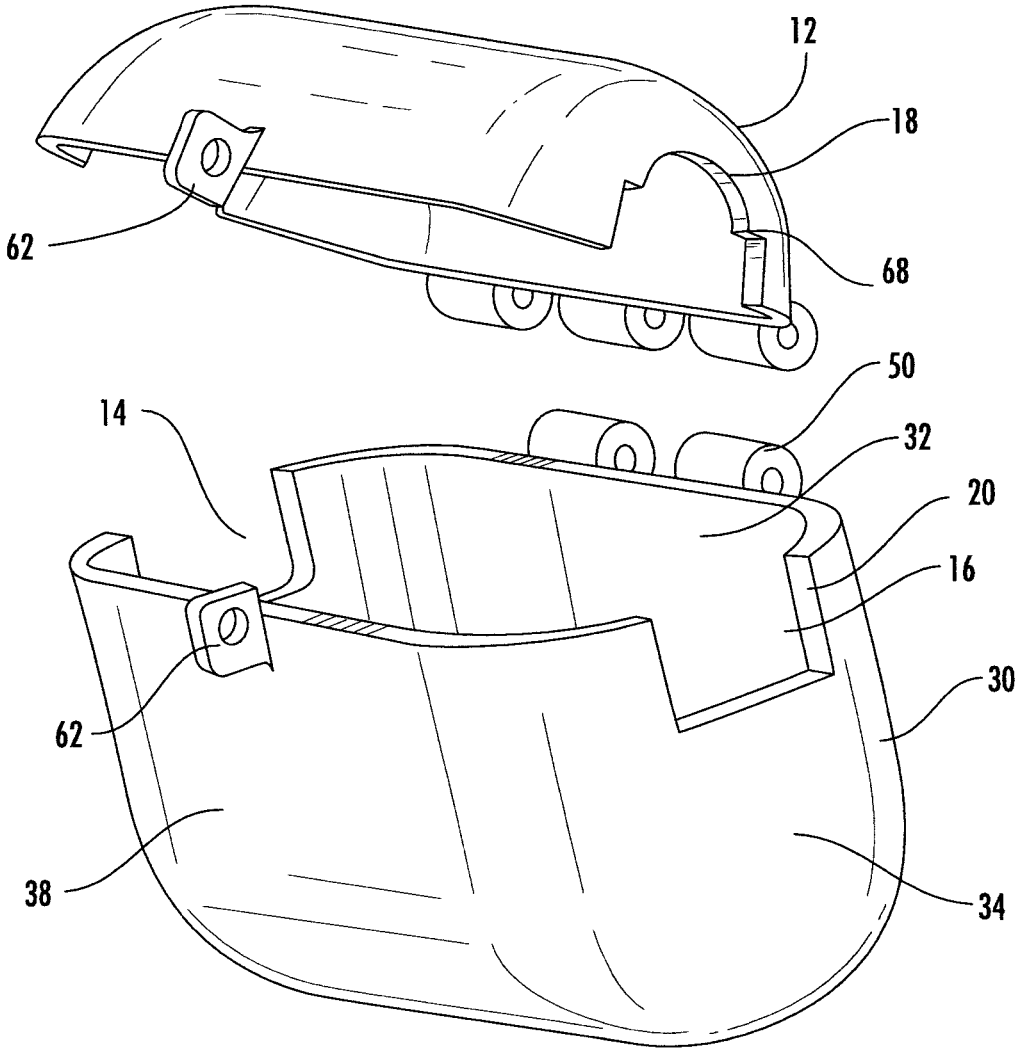
FIG. 1 illustrates an exploded perspective front view of the two main components of the security box and the side openings.
Figure 2:
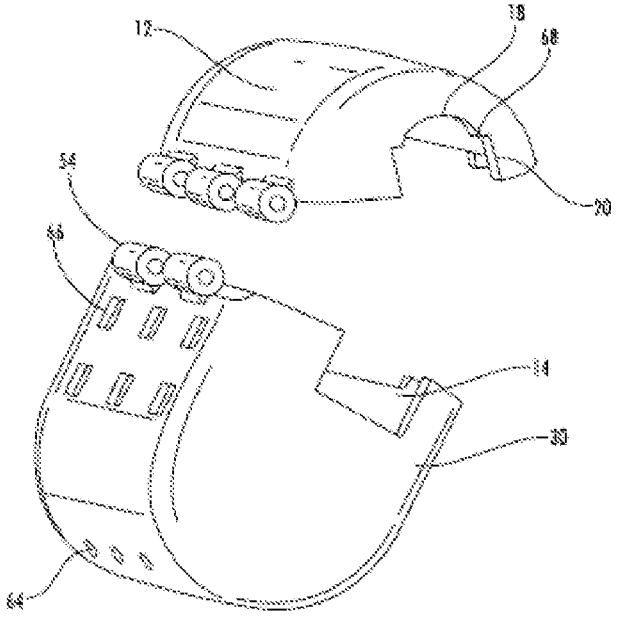
FIG. 2 illustrates an exploded perspective view from the back of the two main components of the security box and the side openings.
Figure 3:
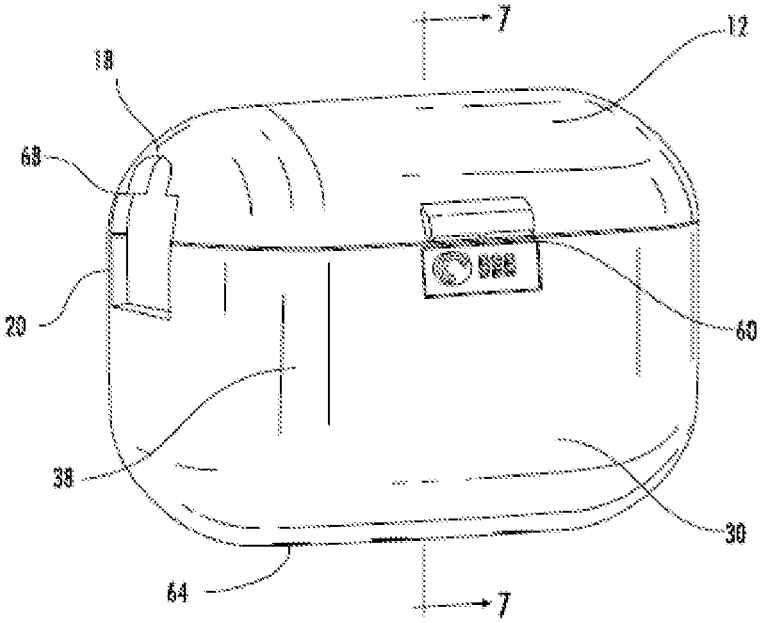
FIG. 3 shows a front view of both main components when assembled.
Figure 4:
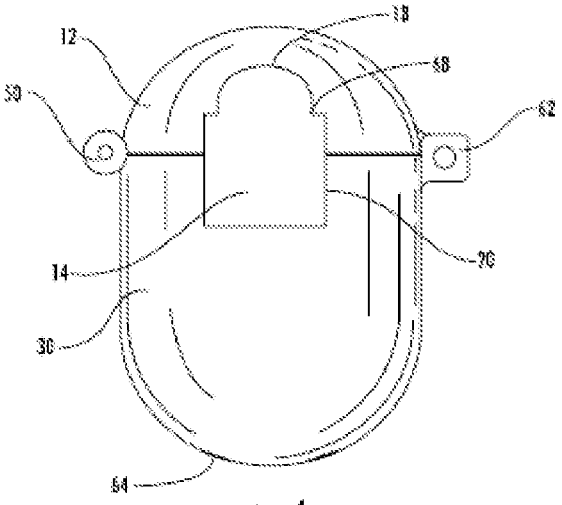
FIG. 4 shows a side view of both main components when assembled.
Figure 5:
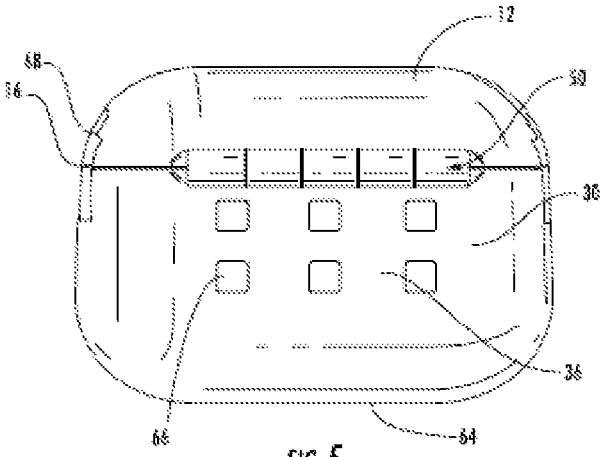
FIG. 5 shows a rear view of both main components when assembled.

As shown in FIGS. 1 and 2 the security box 10 of the present invention has a top component 12 which connects to the bottom component 30 through an integrally attached hinge 50. The hinge 50 operates by tapping a tapered pin 52 into each side of the hinge extensions 54. The top component 12 is hinged and movable relative to the bottom component 30 to close the top component 12 onto the top of the bottom component 30. As shown in FIG. 1, the hasps 62 of the locking mechanism 60 come together so they may be locked with a padlock to secure the user's valuables inside. Alternately, as shown in FIGS. 3 and 7, the lockable security box 10 may have a self-contained locking mechanism 60, such as an integral briefcase style locking mechanism as described more fully below.

As best shown in FIGS. 1, 2, 4 and 7, the top component 12 includes opposed side openings 14 and 16. In a preferred form of the present invention, the side openings 14 and 16 are formed by the combination of the upper arcuate portion 18, corner lip 68, straight side portions 20 of the top component 12 and the generally straight sides and generally rectangular shape of the side openings 14 and 16 of the bottom component 30. The combination of the arcuate portion 18, the corner lip 68, and the straight side portions 20 allows the side openings 14 and 16 to engage a variety of cross sectional shapes of elongate support bars 70. When the support bar 70 has a circular cross section, the support bar 70 will typically contact the upper arcuate portion 18 of the side openings 14 and 16. When the support bar 70 has a rectangular, oval or other shaped cross section, the support bar 70 will contact either the corner lip 68 or both the upper arcuate portion 18 and the corner lip 68 of the side openings 14 and 16 to reduce the movement of the lockable security box 10 relative to the support bar 70 when the lockable security box 10 encloses the support bar 70. In this configuration, the security box cannot be removed from the support bar without cutting though the support bar or breaking the hinge or locking mechanisms of the present invention.

Figure 7:
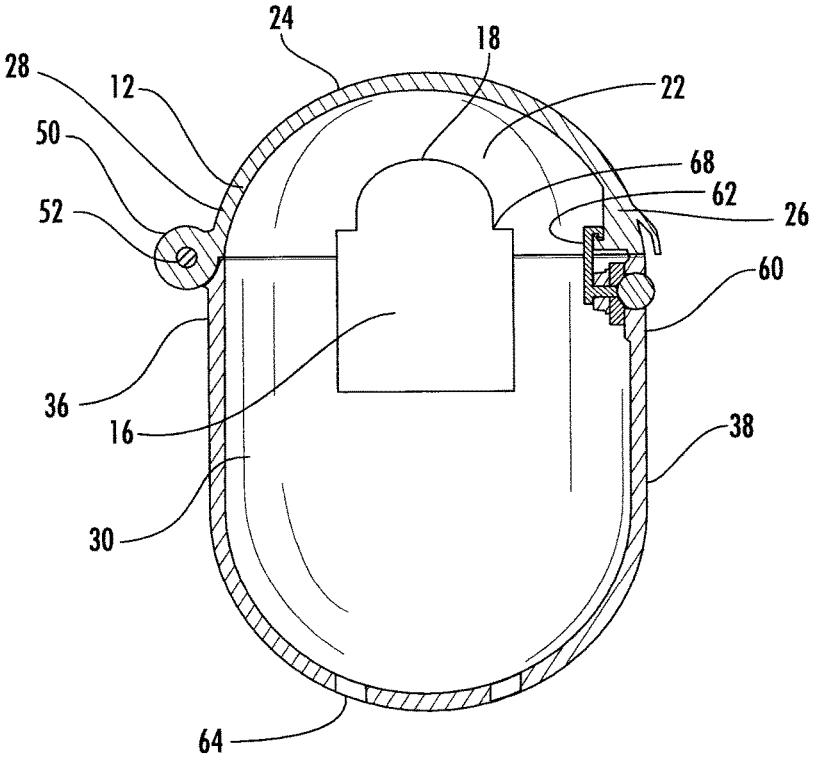
FIG. 7 shows a cross sectional view of a security box taken generally along the plane generally bisecting the embodiment of the invention shown in FIG. 3.

As shown in FIGS. 1, 2 and 7, the top component 12 includes an inner surface 22 and an outer surface 24. In a preferred form of the present invention, the inner surface and the outer surface of the top component 12 are preferably of generally uniform thickness, although, it is anticipated that the thickness may vary to reinforce certain sections of the top component or to accommodate various manufacturing processes. The top component is preferably manufactured of an ABS material, although a variety of other strong and durable materials such as Poly Carbonates, nylon composites, carbon fibers or certain other high strength materials may be used to provide the attributes desired in the present invention. As shown in FIGS. 1, 2 and 7, the top component has a generally elongate lengthwise dimension between the side openings 14 and 16 and is generally u-shaped in cross sectional shape between the front surface 26 and the back surface 28 of the top component. The height of the top component is generally chosen to be sufficient to accommodate the majority of cross sectional sizes of intended support bar 70 in the side openings 14 and 16, while providing sufficient structural integrity around the support bar 70 and in combination with the bottom component 30 to provide secure engagement with the support bar. The back surface 28 of the top component 12 preferably includes a plurality of outwardly extending hinge extensions 54 having circular openings there through to securely retain the tapered pins 52 therein when the lockable security box is assembled. The front surface 26 of the top component 12 includes at least a portion of the locking mechanism 60 thereon. As shown in FIG. 1, a hasp member 62 extends forwardly from the front surface 26 of the top component 12 in a manner to allow the side by side positioning of the hasp 62 from the bottom component 30 to allow the insertion of a portion of a lock through each of the hasps to securely close the lockable security box 10. As also described in this application and shown in FIG. 7, the locking mechanism 60 may also consist of a self-contained lock similar to the types of locks used for bicycles, storage units or similar devices. In this form of the locking mechanism 60, a combination lock type feature extends or retracts a hasp member 62 that is engaged in a recessed portion located along the inner surface 22 of the top component 12.

As shown in FIGS. 1, 2 and 7, the bottom component 30 includes an inner surface 32 and an outer surface 34. In a preferred form of the present invention, the inner surface and the outer surface of the bottom component 30 are preferably of generally uniform thickness, although, it is anticipated that the thickness may vary to reinforce certain sections of the bottom component or to accommodate various manufacturing processes or even to provide an internal support surface for the valuables of the user. The bottom component 30 is preferably manufactured of an ABS material, although a variety of other strong and durable materials such as Poly Carbonates, nylon composites, carbon fibers or certain other high strength materials may be used to provide the attributes desired in the present invention. As shown, the bottom component 30 has a generally elongate lengthwise dimension between the side openings 14 and 16 and is generally ovoid, elliptical or u-shaped in cross sectional shape between the front surface 38 and the back surface 36 of the bottom component 30. In the preferred form of the present invention, the inner surface 32 of the bottom component preferably forms a recessed area that has sufficient size to retain the valuables from multiple people. The height of the bottom component 30 is generally chosen to provide sufficient interior volume to accommodate the majority valuables typically carried by beach, park or pool goers. As with the top component 12, the bottom component 30 preferably includes a greater lengthwise dimension than the width dimension to provide a bottom component which extends along the lengthwise dimension of an elongate support bar 70. The bottom component 30 includes the bottom portions of the side openings 14 and 16. In the preferred form of the side openings 14 and 16, the shape on the bottom component is preferably rectangular to accommodate a variety of sizes of cross sectional shapes of the typical elongate support bar 70 while providing sufficient structural integrity around the support bar 70 and in combination with the top component 12 to provide secure engagement with the support bar 70. The back surface 36 of the bottom component 30 preferably includes a plurality of outwardly extending hinge extensions 54 having circular openings there through to securely retain the tapered pins 52 therein when the lockable security box 10 is assembled. As further shown in FIG. 2, the bottom surface of the bottom component 30 may include a plurality of drainage holes 64 to allow for drainage if the interior compartment of the lockable security box 10 gets wet. FIG. 2 also shows the back surface 36 of the bottom component as including a plurality of square box shaped openings 66 which are carved out and can be punched through to create a place where fasteners may be affixed if deemed necessary by a consumer.

The front surface 38 of the bottom component 30 includes at least a portion of the locking mechanism 60 thereon. As shown in FIG. 1, a hasp member 62 may extend forwardly from the front surface 38 of the bottom component 30 in a manner to allow the side by side positioning of the hasp 62 from the top component 12 to allow the insertion of a portion of a lock through each of the hasps to securely close the lockable security box 10. As also described in this application and shown in FIGS. 3 and 7, the locking mechanism 60 may also consist of a self-contained lock similar to the types of locks used for bicycles, storage units or similar devices. In this form of the locking mechanism 60, a combination lock type feature engages a hasp member 62 that extends upwardly from the inner surface 32 of the bottom component 30 and is engaged in a recessed portion located along the inner surface 22 of the top component 12. Also as shown in the drawings, a handle type member may extend from the front surface 26 of the top component 12 to provide the user with an element to grasp as the security box 10 is opened or closed. An example of a preferred form of the present invention, the bottom of the interior surface area of the bottom section 30 and top section 12 of the lockable security box 10 is approximately 60 square inches security accommodate phones, wallets, sunglasses etc. from the typical user. A preferred form of the lockable security box preferably has a general dimension of approximately inches by 6.5 inches by 5.5 inches with an approximate size of 375 cubic inches.

Figure 6:
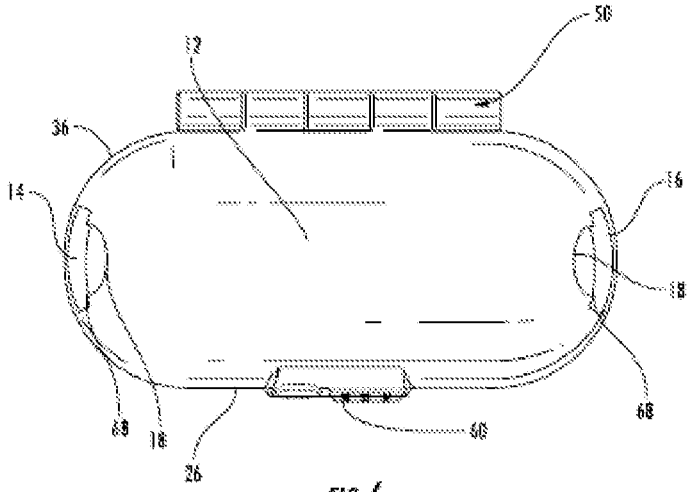
FIG. 6 shows a top view of both main components when assembled.
Figure 8:
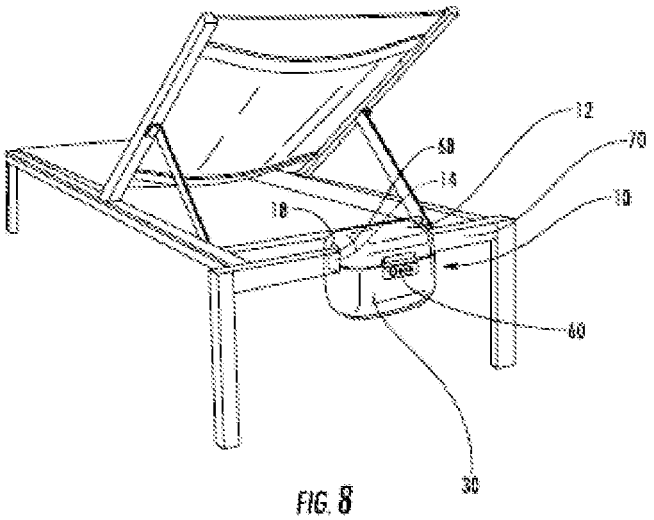
FIG. 8 is a perspective view of the present invention attached to the support bar of a lawn chair.

FIGS. 6 and 8 are illustrative of the top and perspective views of a preferred form of the present invention. FIG. 8 shows the ability of support bar 70 running all the way through the invention through the side openings 14 and 16 to allow for the fixed object, such as the support bar 70, to center the gravitational pull of the bottom component 30 of the lockable security box 10 and its contents to the middle of the invention eliminating lopsidedness. As shown in the drawings, this feature is accomplished through the combination of the arcuate portion 18, corner lip 68 of the top component 12 and the generally straight sides and generally rectangular shape of the side openings 14 and 16 of the bottom component 30. Because the lockable security box 10 encloses around the support bar 70 and the support bar 70 has no free ends, the lockable security box 10 is retained on the desired structure until the present invention is opened by the user. Similarly, because the components of the lockable security box 10 are formed of a material that does not allow the contents of the box to be visible there through and the side openings of the box are shaped to minimize the ability to see into the box through the side openings, thus the contents are not readily viewable without opening the lockable security box.

What is claimed is:

1. A lockable security box comprising;

a top component having an inner surface, an arcuate outside surface, a bottom surface and front and back surface portions and a pair of spaced apart partial side openings wherein said partial side openings each include an upper arcuate surface thereon;

a bottom component having an inner surface, an outside surface, a top surface and front and back surface portions and a pair of spaced apart partial side openings wherein said partial side openings each include a rectangular shaped portion thereon;

a support cavity formed by the inner surface of the top component and the inner surface of the bottom component;

the support cavity further including a pair of side openings which are formed by the partial side openings in the top component and the partial side openings in the bottom component and the support cavity has a greater length dimension between the side openings than the height dimension along the inner surfaces of the top component and bottom component and a greater length dimension than the width dimension formed between the front and back surface portions of the top and bottom components along the bottom surface of the top component and the top surface of the bottom component;

a hinge member and a locking member;

wherein said top component attaches to said bottom component with the hinge member on said back surface portion of said top and bottom components and the locking member includes components on said front surface portion of said top and bottom components and wherein the top component and bottom component are movable relative to each other between first and second positions via the hinge member and wherein when the top component is locked relative to the bottom component in the second position, the bottom surface of the top component abuts flush against the top surface of the bottom component and the support cavity is created therein;

wherein the outside surfaces of the top and bottom components form a three-dimensional shaped member which surrounds the support cavity; and wherein the top component further includes a generally elongate lengthwise dimension between the two partial side openings and is generally curvilinear in cross sectional shape along the plane generally extending between the front surface portion and the back surface portion of the top component adjacent to the bottom surface thereof and said arcuate surface of said partial side openings include a pair of corner surfaces at each end thereof spaced apart from the bottom surface of the top component.

2. The security box of claim 1 wherein the bottom component further includes a generally elongate lengthwise dimension between said partial side openings therein and is generally u-shaped incross sectional shape along a plane generally extending perpendicular to the lengthwise dimension.

3. A lockable security box comprising;

atop component having an inner surface, an arcuate outside surface, a bottom surface and front and back surface portions and a pair of spaced apart partial side openings wherein said partial side openings each include an arcuate surface thereon and said top component includes a lengthwise dimension between the partial side openings that is greater than the width dimension thereof adjacent to the bottom surface of the top component;

a bottom component having an inner surface, an outside surface, a top surface and front and back surface portions and a pair of spaced apart partial side openings wherein said partial side openings of said bottom component are larger than the partial side openings of said top component and said bottom component includes a lengthwise dimension between the partial side openings that is greater than the width dimension thereof adjacent to the top surface of the bottom component;

a support cavity formed by the inner surface of the top component and the inner surface of the bottom component;

the support cavity further including a pair of side openings formed by the partial side openings in the top and bottom components and which are formed by an arcuate portion on each of the partial side openings in the top component and the larger partial side openings of the bottom component and the support cavity has a greater length dimension between the side openings than the width dimension formed between the front and back surface portions of the bottom surface of the top component and the top surface of the bottom component;

a hinge member and a locking member;

wherein the back surface portion of said top component attaches to the back surface portion of said bottom component using the hinge member and the locking member is located along the front surface portion of the top and bottom components and wherein the top component and bottom component are movable between a first open position and a second closed position;

wherein the combination of the top component and bottom component create said support cavity by placement of said side openings along the lengthwise dimension of the top and bottom components such that said support cavity can accommodate a variety of different objects extending between the side openings and wherein said bottom surface of said top component and said top surface of said bottom component fit flush against each other in the second closed position;

the height of the top component is sufficient to hold an elongate object extending between the side openings thereof and through the support cavity with sufficient structural integrity to support the weight of the security box and the weight of objects in said security box;

wherein the outside surface of the top and bottom components form a three-dimensional shaped member having multiple curved edges which surround the support cavity; and wherein the arcuate surface of the partial side openings is located in the top component and a pair of corners are located adjacent to the ends of the arcuate surface in the top component and said corners are spaced apart from the top surface of the bottom component in the second closed position of the top and bottom components.

4. A lockable security box comprising;

atop component having an inner surface, an arcuate outside surface, a bottom surface and front and back surface portions and a pair of spaced apart partial side openings wherein said partial side openings each include an arcuate surface thereon and said top component includes a lengthwise dimension between the partial side openings that is greater than the width dimension thereof adjacent to the bottom surface of the top component;

a bottom component having an inner surface, an outside surface, a top surface and front and back surface portions and a pair of spaced apart partial side openings wherein said partial side openings of said bottom component are larger than the partial side openings of said top component and said bottom component includes a lengthwise dimension between the partial side openings that is greater than the width dimension thereof adjacent to the top surface of the bottom component;

a support cavity formed by the inner surface of the top component and the inner surface of the bottom component;

the support cavity further including a pair of side openings formed by the partial side openings in the top and bottom components and which are formed by an arcuate portion on each of the partial side openings in the top component and the larger partial side openings of the bottom component and the support cavity has a greater length dimension between the side openings than the width dimension formed between the front and back surface portions of the bottom surface of the top component and the top surface of the bottom component;

a hinge member and a locking member;

wherein the back surface portion of said top component attaches to the back surface portion of said bottom component using the hinge member and the locking member is located along the front surface portion of the top and bottom components and wherein the top component and bottom component are movable between a first open position and a second closed position;

wherein the combination of the top component and bottom component create said support cavity by placement of said side openings along the lengthwise dimension of the top and bottom components such that said support cavity can accommodate a variety of different objects extending between the side openings and wherein said bottom surface of said top component and said top surface of said bottom component fit flush against each other in the second closed position;

the height of the top component is sufficient to hold an elongate object extending between the side openings thereof and through the support cavity with sufficient structural integrity to support the weight of the security box and the weight of objects in said security box;

wherein the outside surface of the top and bottom components form a three-dimensional shaped member having multiple curved edges which surround the support cavity; and wherein the side openings formed by the top component and bottom component include an arcuate portion having a pair of corners at each end thereof and a generally rectangular shaped portion along the partial side openings on the bottom component and wherein the corners are spaced apart from the bottom component in the second closed position of the top and bottom components.

5. A lockable security box comprising;

a top component having an inner surface, an arcuate outside surface, a bottom surface and front and back surface portions and a pair of spaced apart partial side openings wherein said partial side openings each include an arcuate surface thereon with said top component having sufficient structural integrity to support the weight of the lockable security box and objects capable of being stored in said security box, the top component further having a lengthwise dimension between the partial side openings that is greater than the width dimension formed between the front and back surface portions along the bottom surface thereof;

a bottom component having an inner surface, an outside surface, a top surface and front and back surface portions and a pair of spaced apart partial side openings wherein said partial side openings are larger than the partial side openings of the top component and said bottom component includes a lengthwise dimension between the partial side openings that is greater than the width dimension between the front and back surface portions along the top surface of the bottom component;

a hinge member and a locking member;

a support cavity formed by the inner surface of the top component and the inner surface of the bottom component wherein the top component is movable relative to the bottom component between open and closed positions along the hinge member located adjacent to and attached to the back and bottom surface of the top component and the back and top surface of the bottom component and said support cavity includes a pair of side openings formed when said partial side openings of said top component and said partial side openings of said bottom component are positioned adjacent to each other in the closed position;

the locking member having components located on the front surface portion of each of the top and bottom components to create the lockable security box that is engageable with an elongate member extending through the side openings and support cavity such that the support cavity is sufficient in size to hold an object therein;

the top component and the bottom component each have a generally elongate lengthwise dimension between the two side openings and each are generally curvilinear in cross sectional shape along the plane that is generally perpendicular to the lengthwise dimension and extending between the front surface portion and the back surface of the top component adjacent to the bottom surface portion thereof and the top surface of the bottom component; and the support cavity has a greater length dimension between the side openings than the height dimension of the security box and a greater height dimension than the width dimension formed between the front and back surface portions of the top component adjacent to the bottom surface thereof and the top surface of the bottom component and when the top component and bottom component are in the closed position, the top surface of the bottom component and the bottom surface of the top component abut flush against each other.

* * * * *